US009609962B2

(12) United States Patent
Bruns

(10) Patent No.: US 9,609,962 B2
(45) Date of Patent: Apr. 4, 2017

(54) PACKAGED COLLECTIBLE DISPLAY SYSTEM AND ASSEMBLY

(71) Applicant: John W. Bruns, Palatine, IL (US)

(72) Inventor: John W. Bruns, Palatine, IL (US)

( * ) Notice: Subject to any disclaimer, the term of this patent is extended or adjusted under 35 U.S.C. 154(b) by 0 days.

(21) Appl. No.: 14/690,623

(22) Filed: Apr. 20, 2015

(65) Prior Publication Data

US 2015/0225156 A1 Aug. 13, 2015

Related U.S. Application Data

(63) Continuation-in-part of application No. 13/920,334, filed on Jun. 18, 2013, now abandoned.

(51) Int. Cl.
*B65D 73/00* (2006.01)
*A47F 7/00* (2006.01)
*A47F 5/16* (2006.01)

(52) U.S. Cl.
CPC ..... *A47F 7/0042* (2013.01); *A47F 5/16* (2013.01); *A47F 2005/165* (2013.01); *A47F 2007/0092* (2013.01)

(58) Field of Classification Search
CPC .... A47F 7/0042; A47F 2005/165; A47F 5/16; A47F 2007/0092; B65D 25/10; B65D 5/5213
USPC ..... 206/758, 764, 756, 468; 248/309.1, 451, 248/453, 316.7, 316.3; 24/278.1, 3.12
See application file for complete search history.

(56) References Cited

U.S. PATENT DOCUMENTS

| | | | | | |
|---|---|---|---|---|---|
| 4,190,182 | A * | 2/1980 | Hickey | A45F 5/10 | 224/917 |
| 4,291,882 | A * | 9/1981 | Del Monte | A63F 3/06 | 273/148 A |
| 5,249,683 | A | 10/1993 | Baucom | | |
| 5,938,031 | A * | 8/1999 | Woods | B65D 25/10 | 206/425 |
| 6,722,070 | B2 | 4/2004 | Ribaudo | | |
| 8,276,751 | B2 | 10/2012 | Zorc | 206/349 | |
| 2004/0129851 | A1 | 7/2004 | George | | |
| 2012/0160726 | A1 | 6/2012 | Gelardi | 206/468 | |
| 2013/0075552 | A1 * | 3/2013 | Kenney | A47B 77/14 | 248/205.3 |

* cited by examiner

*Primary Examiner* — Andrew Perreault
(74) *Attorney, Agent, or Firm* — Charles F. Meroni, Jr.; Meroni & Meroni, PC

(57) ABSTRACT

A packaged collectible display assembly displays a packaged collectible. The packaged collectible display assembly includes a board assembly and a display base. The board assembly includes a backer board, at least one pair of laterally opposed channel structures or constructions, and a ledge structure or element. The channel structures are attached to the laterally opposed portions of the backer board such as laterally opposed board edges such that channels of the channel structures face one another. The ledge structure is attached to the backer board adjacent the lower board end such that the ledge length extends across the board width and abuts the lower channel ends, the ledge structure and channel structures for supporting at least one channel-received packaged collectible. The lower board end may be preferably received in groove formed in the display base for enhancing the display of each channel-received packaged collectible.

14 Claims, 12 Drawing Sheets

PACKAGED COLLECTIBLE DISPLAY SYSTEM AND ASSEMBLY

PRIOR HISTORY

This non-provisional Continuation-in-Part patent application claims the benefit of pending U.S. patent application Ser. No. 13/920,334 ('334 application) filed in the United States Patent and Trademark Office (USPTO) on 18 Jun. 2013, which '334 application then claimed the benefit of U.S. Provisional Patent Application No. 61/690,099 filed in the USPTO on 19 Jun. 2012.

BACKGROUND OF THE INVENTION

Field of the Invention

The present invention relates generally to a display assembly. More particularly, the present invention relates to display assembly for use in combination with packaged collectible display assembly for enabling users to display collectibles as exemplified by packaged collectible vehicle toys or models.

Brief Description of the Prior Art

U.S. Pat. No. 5,249,683 ('683 patent), issued to Baucom, discloses a Mounting device for Displaying Packaged Three-Dimensional Articles and Article Display Formed Therewith. The '683 patent describes collectible and other consumer articles packaged for retail sale on a supporting card can be displayed intact in their original packaging by a mounting board formed with openings each of a shape and size conforming to the packaged article by mounting each package to the rearward side of the mounting board with the article protruding forwardly through a respective opening and the card abutting the rearward side of the board, so that substantially only the articles are displayed at the forward face of the board and the supporting cards are masked by the board.

U.S. Pat. No. 6,722,070 ('070 patent), issued to Ribaudo, discloses a Sports Memorabilia/Card Display. The '070 patent describes a display system having a substantially flat front portion for holding and displaying memorabilia. The display system comprises a frame, a backing supported by the frame, a plurality of cardholders for holding photographic memorabilia and a recessed chamber for holding an object of memorabilia associated with the photographic memorabilia. The cardholders retain trading cards and are attachable to the backing. The cardholders are arranged about the chamber in an aesthetic manner.

United States Patent Application Publication No. 20040129851, authored by George, discloses a Hanging Display Device. The George disclosure describes a novel hanging display device for displaying various articles. Specifically exemplified is a display device for displaying collectibles contained in original box. The hanging display device comprises a base for providing bottom support to item being displayed; a back support integral with or attached to said base, wherein said back support comprises at least one aperture defined thereon to receive at least one connector for hanging said hanging display device; and an adjustable bracket slidingly engaged to said back support, said adjustable bracket may be adjusted to fit several different sizes of display items.

As will be understood from a consideration of the foregoing art hereinabove being cited as exemplary to the state of the art, that there does not appear to be a packaged collectible display assembly for displaying packaged collectibles wherein the display assembly comprises a backer board, at least one pair of laterally opposed J-channel structures, a ledge structure, and base assembly whereby the J-channel structures and ledge structure are attached to the backer board, and which backer board is received in and upwardly positioned by the display base. Accordingly, the prior art perceives a need for such a display assembly as briefly summarized in more detail hereinafter.

SUMMARY OF THE INVENTION

A favorite hobby enjoyed by countless people is collecting toys and memorabilia. A science fiction enthusiast, for example, might avidly collect Star Wars action figures; a young baseball fan might collect cards of Major League Baseball players; or a nostalgic mother might collect various incarnations of a Barbie doll. Many collectables greatly increase in value over time. Most serious collectors take proper care of their collectibles, keeping original packaging and avoiding handling their collections unless absolutely necessary.

The majority of collectors display their goods by setting the individual items on a shelf, desk top or within a curio cabinet. Displaying collections in this manner often becomes cluttered and disorganized. For the many collectors who own hundreds of smaller objects, such as Matchbox cars of Happy Meal toys, finding enough room to properly display each piece from their collection is nearly impossible. Another challenge for serious collectors is safe and organized transport of their collections to and from trade and display shows.

Such gatherings are increasing in popularity each year, and thousands of collectors eagerly anticipate the opportunity to show off the fruits of their hobby and possibly exchange a duplicate item for a new collectible item from another collector. Unorganized boxes of comic books, action figures or die cast automobile models are not conducive to showing off these items in an effective manner. It is a primary object of the present invention to provide a portable display case for packaged collectibles, as exemplified by toy or model vehicles.

To achieve this primary, and other readily apparent objectives, the present invention essentially provides a Collect N Trade Carry All display assembly, is a display apparatus especially designed for transporting and displaying collectible auto models. The design intent is to provide collectors with a durable yet efficient means of preserving their possessions in original packaging for display purposes while facilitating easy transport to trading shows and similar events.

The Collect N Trade Carry All display assembly provides great storage and display for small scale and die cast trucks, cars, and tractors. The Collect N Trade Carry All display assembly is an elongated and vertically positioned board configured case that is fabricated in durable yet lightweight plastic, wood or metal. For a basic unit that houses up to six models in their original boxes, the line includes a rectangular unit that measures approximately twenty four inches in height, five and one sixteenth inches in width, and three inches in depth.

Comprising about two inches of the height, the top of the case comprises a curved area that contains an attractively grooved cutout that serves as a case handle. Extending downward, the storage area of the Collect N Trade Carry All display assembly comprises a three-sided enclosure with a small lip extension on each side of the front that securely envelops items while providing an open front facing for an unobstructed view of the collectibles.

Each case contains sliding tracks on the sides to facilitate joining two cases into a double display for up to twelve units. The Collect N Trade line manufactures a smaller case in height for housing and carrying two to six items. The Collect N Trade Carry All display assembly may comprise an optional transparent hinge mounted lid on its front to further secure and show inside items. Attractive as well as practical, the Collect N Trade line is sold in various colors and styles to appeal to individual tastes.

Use and application of the Collect N Trade Carry All display assembly is simple and straightforward. An auto model collector selects the appropriate size and number of display assemblies to accommodate their collection. Positioning the display assembly upright, a user slides a packaged vehicle or similar other packaged collectible into the top of the present invention with the package's display area facing forward. The package rests upon a ledge element attached adjacent a bottom end of the display assembly.

Other items are inserted in a stacking manner, one on top of the other. Closing an optionally provided lid, the user then suspends the Collect N Trade Carry All display assembly on an appropriate wall or shelf. For transport to a trade show, a simple grip on the provided handle allows the user to carry a secured display assembly to an automobile, inside an arena, to a display spot, and back out again.

The Collect N Trade Carry All display assembly provides auto model collectors with a simple and effective means of showcasing as well as transporting their beloved collectibles. Securely protected within a form fitted receptacle behind an optional translucent plastic or glass lid, a collector's valuable collections are safely and attractively showcased in original packaging. Whether small scale reproductions of vehicles, aircraft, farming equipment, motorcycles, or monster trucks, the Collect N Trade Carry All display assembly provides optimal protection against dings and dents that occur when items are loose on shelves or in other forms of storage.

An effective organizational tool, this wall or shelf mounted display assembly eliminates clutter associated with displaying collections on overcrowded desktops or dressers when storage space is limited. With an integrated handle, this lightweight display assembly is ideal for conveyance to trade and collector's shows, beautifully and brilliantly displaying one's prize acquisitions. The Collect N Trade Carry All is manufactured in a wide variety of designs, colors, and sizes. Constructed of durable, high quality materials and components, the Collect N Trade Carry All display assembly withstands years of continual use.

BRIEF DESCRIPTION OF THE DRAWINGS

Other features of my invention will become more evident from a consideration of the following brief descriptions of illustrations of the subject invention.

DETAILED DESCRIPTION OF THE PREFERRED EMBODIMENTS

Figure 1:
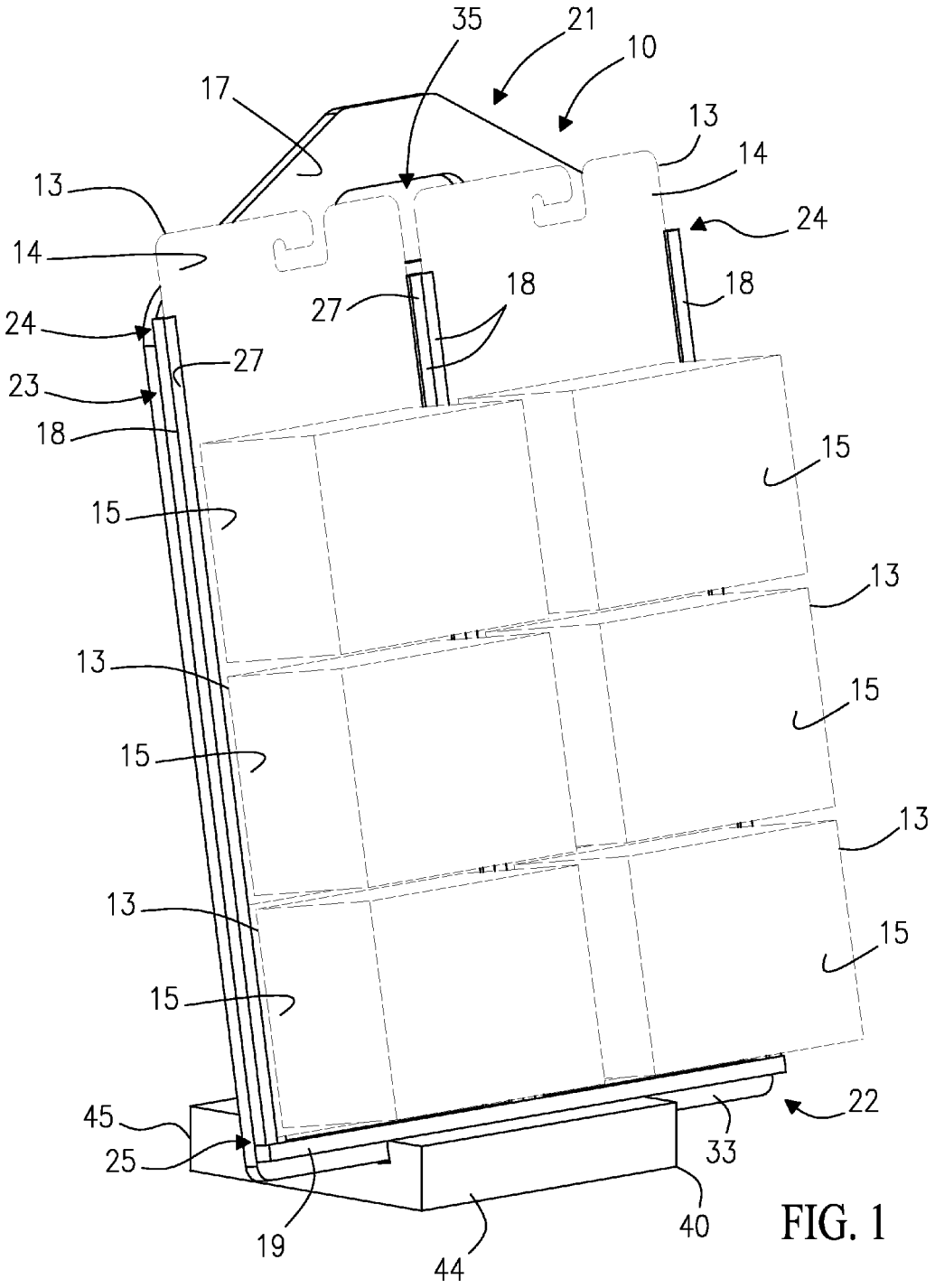
FIG. 1 is an anterior perspective view of a preferred packaged collectible display assembly according to the present invention showing six packaged collectible assemblies displayed by the preferred display assembly, and which six packaged collectible assembles are displayed in two stacked columns of three packaged collectibles.

Referring now to the drawings with more specificity, the preferred embodiment according to the present invention is diagrammatically depicted in FIGS. 1-4B. The preferred embodiment of the packaged collectible display assembly is depicted and referenced at 10. Alternative embodiments of the packaged collectible display assemblies are depicted and referenced at 11 in FIGS. 7-8B and 12 in FIGS. 9-10B with certain supportive illustrations being depicted in FIGS. 5-6A. In other words, the subject matter shown in FIGS. 5-6A attempts to show generic subject matter common to all embodiments of the invention.

The preferred embodiment as referenced at display assembly 10 essentially provides a double-wide or two-column version of embodiment for displaying side-by-side packaged collectible assemblies as depicted and referenced at 13. In contrast to the double-wide or two-column preferred embodiment as depicted and referenced at 10, the alternative embodiments referenced at 11 and 12 essentially provide single column versions of the display assemblies.

Figure 7:
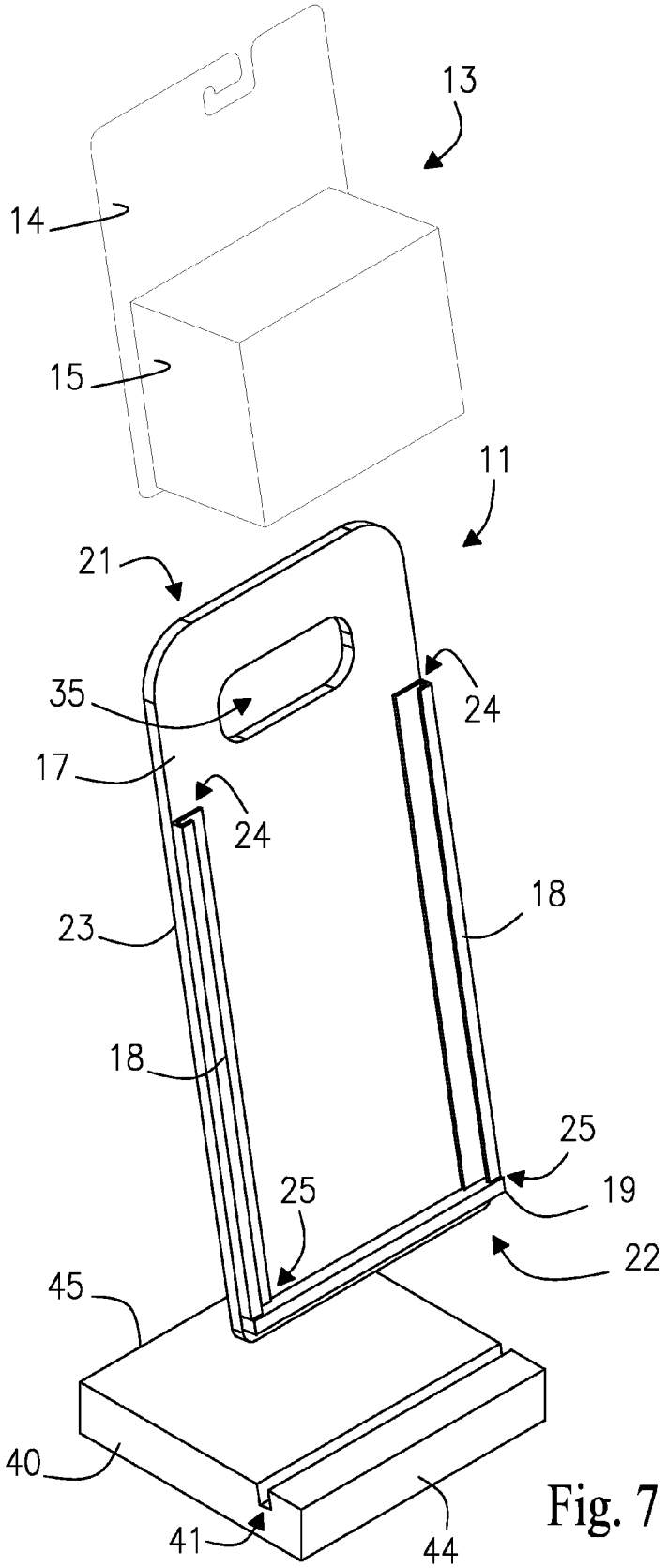
FIG. 7 is a partially exploded anterior perspective view of a first alternative packaged collectible display assembly according to the present invention showing a single packaged collectible assembly exploded from a first alternative board assembly and the first alternative board assembly exploded from a base assembly according to the present invention.
Figures 8, 8A, 8B:
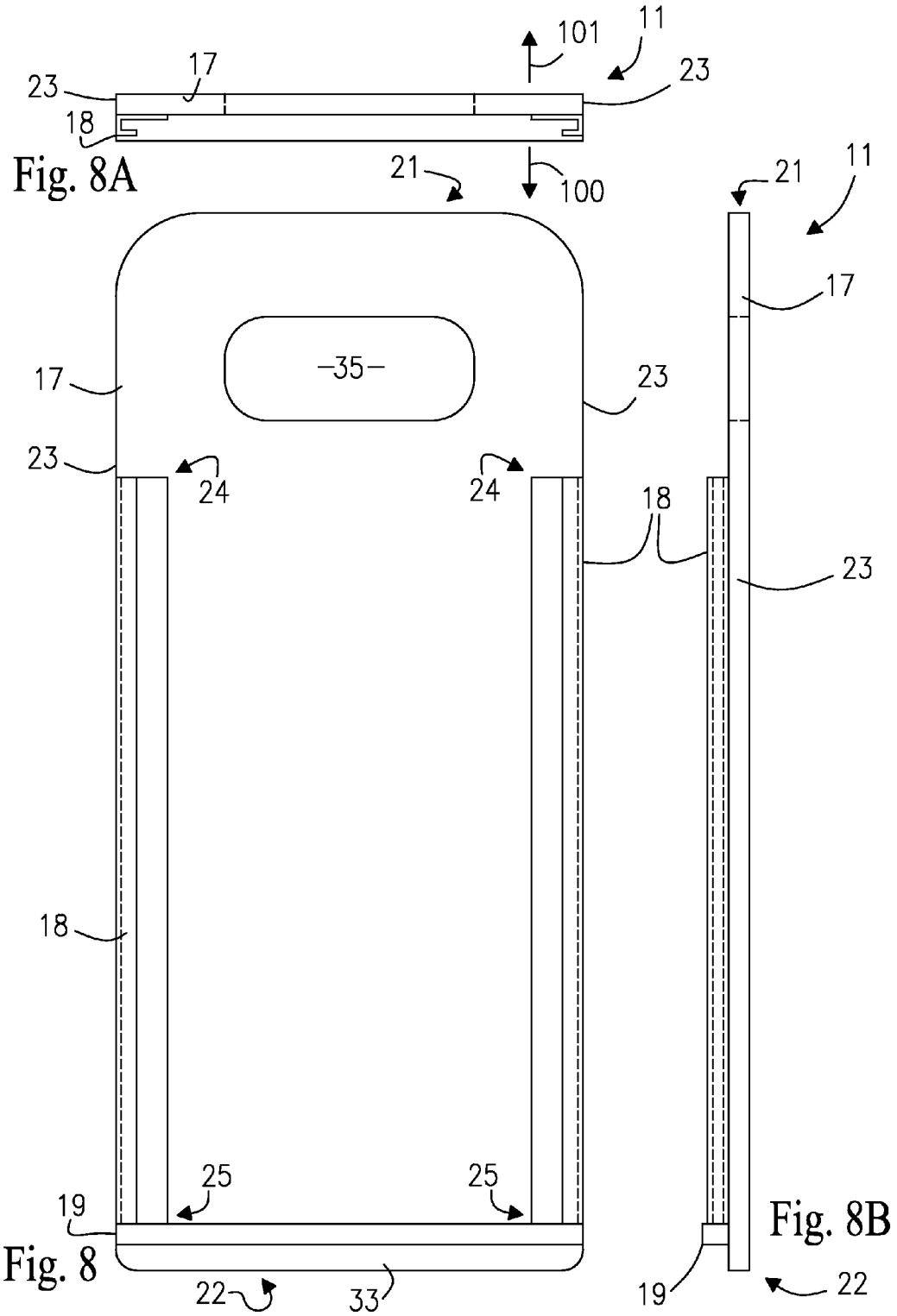
FIG. 8 is an anterior elevational view of the first alternative board assembly of the first alternative packaged collectible display assembly according to the present invention.
FIG. 8A is a top edge view of the first alternative board assembly of the first alternative packaged collectible display assembly according to the present invention.
FIG. 8B is a lateral edge view of the first alternative board assembly of the first alternative packaged collectible display assembly according to the present invention.
Figure 9:
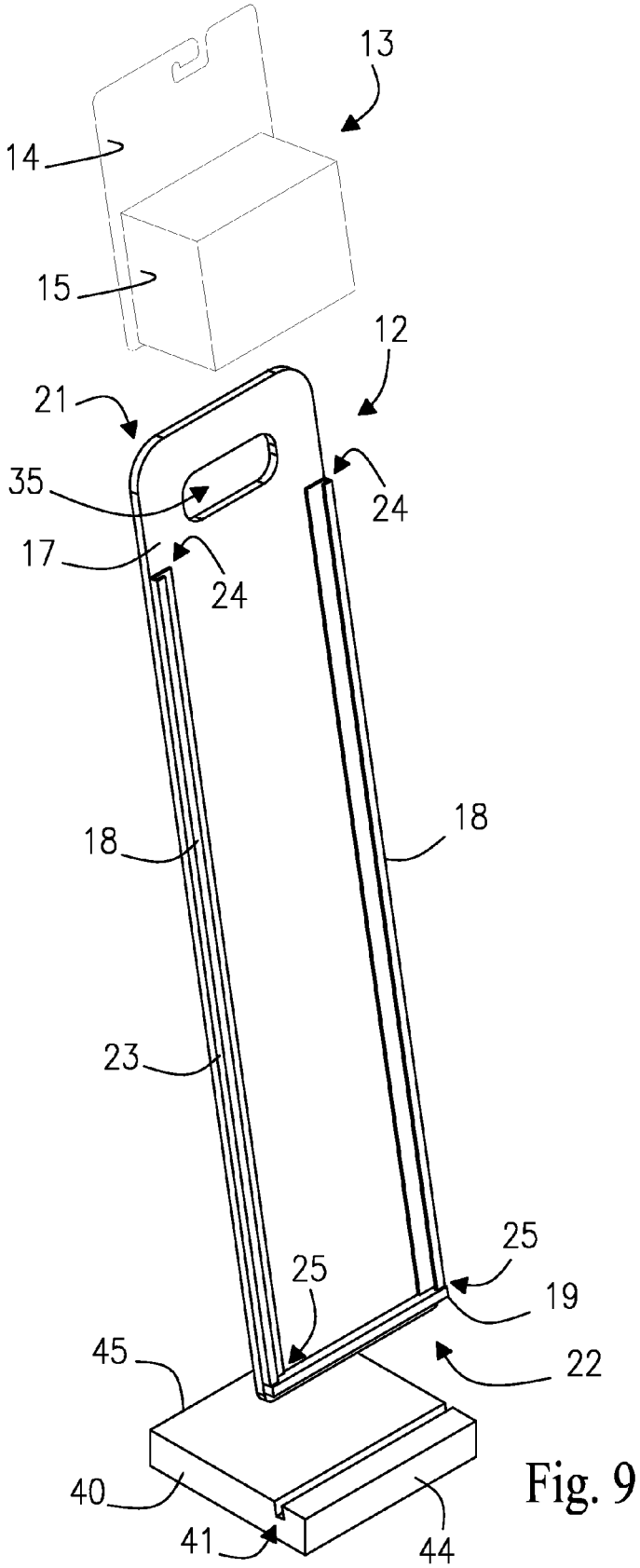
FIG. 9 is a partially exploded anterior perspective view of a second alternative packaged collectible display assembly according to the present invention showing a single packaged collectible assembly exploded from a second alternative board assembly and the second alternative board assembly exploded from a base assembly according to the present invention.
Figure 10A:
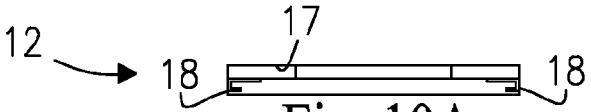
FIG. 10A is a top edge view of the second alternative board assembly of the second alternative packaged collectible display assembly according to the present invention.
Figure 10:
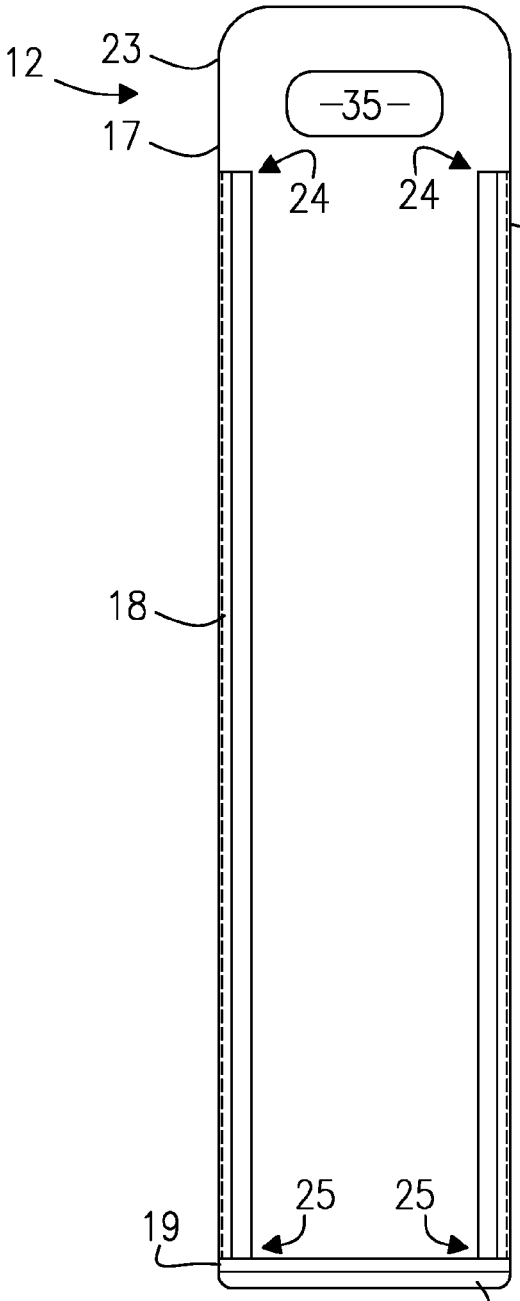
FIG. 10 is an anterior elevational view of the second alternative board assembly of the second alternative packaged collectible display assembly according to the present invention.
Figure 10B:
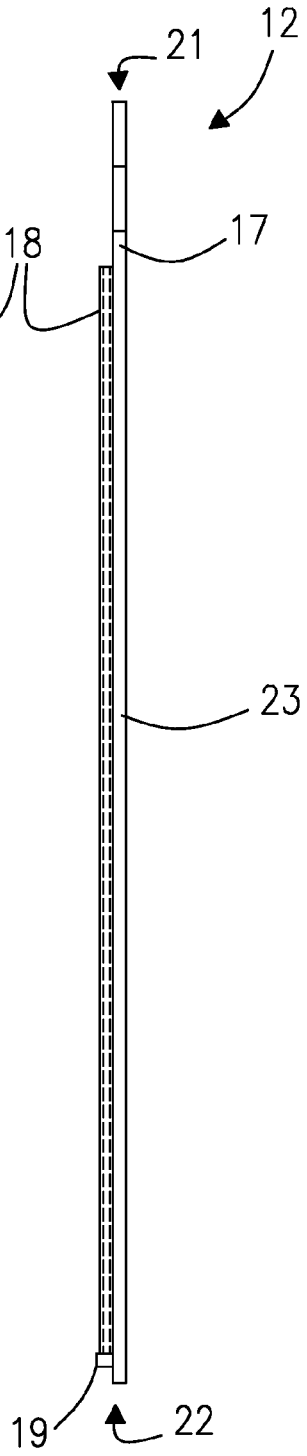
FIG. 10B is a lateral edge view of the second alternative board assembly of the second alternative packaged collectible display assembly according to the present invention.

From a comparative inspection of FIGS. 7-8B versus FIGS. 9-10B, for example, it will be seen that alternative embodiment 11 provides a relatively abbreviated length display assembly and alternative embodiment 12 provides a relatively elongated length display assembly. Preferred embodiment 10 has a length substantially identical to the length of alternative embodiment 11. All three embodiments 10-12 preferably comprise features that are believed generic to one another, and are thus believed properly presented or described in these specifications as representative of a single inventive concept.

The packaged collectible display assemblies 10-12 may be viewed systemically, in a sense, when viewed in combination with the packaged collectible(s) 13. The packaged collectible display system or assembly according to the present invention primarily functions to display the packaged collectibles. Systemically, the invention may be said to comprise, in combination at least one, but preferably multiple packaged collectible assemblies 13; a display assembly as at 10, 11, or 12; and a display base as depicted and referenced at 40.

Figure 6A:
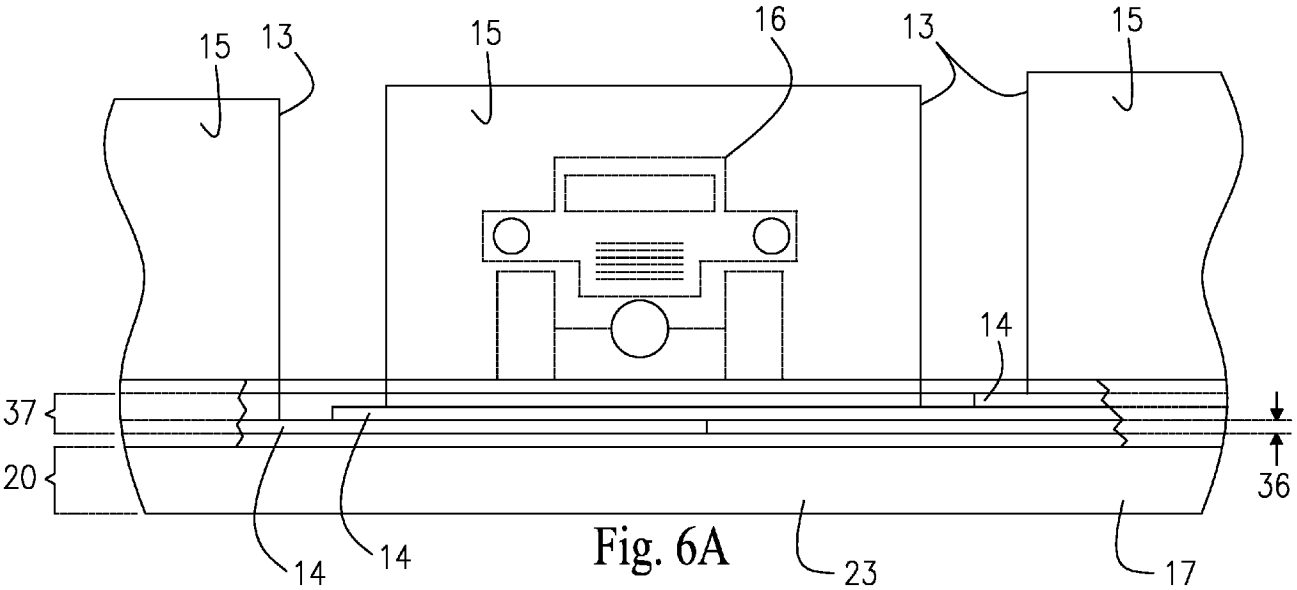
FIG. 6A is an enlarged fragmentary diagrammatic sectional view as sectioned from FIG. 6 and with parts broken away to show in greater detail the relative structural position of packaged collectible assemblies within the J-channel structures and upon the backer board of the packaged collectible display assembly otherwise shown in FIG. 6.
Figure 6:
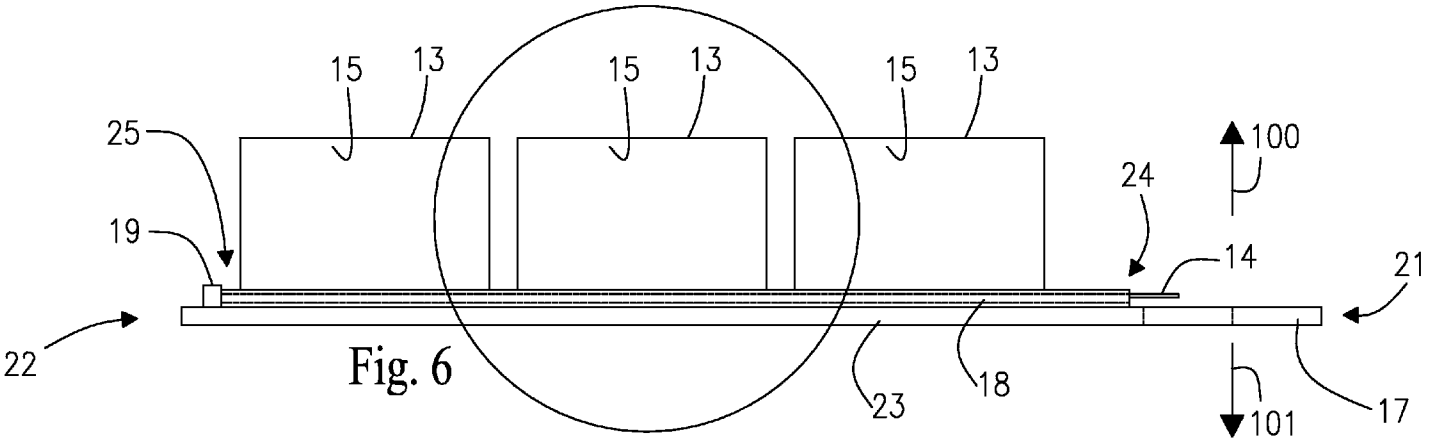
FIG. 6 is a lateral edge view of packaged collectible display assembly according to the present invention showing three packaged collectible assemblies received by the display assembly, and which three packaged collectible assembles are received in a stacked column.

Each (prior art) packaged collectible assembly 13 usable in combination with a display assembly 10, 11, or 12 essentially comprises a backing portion as at 14; a three-dimensional (translucent) collectible-housing, bubble-like display structure as at 15; and a collectible as generally depicted by a toy or model "monster truck" at 16. The collectible-housing display structure 15 is typically adhesively attached to the backing portion 14 and translucently encloses the collectible 16. In other words, the enclosed collectible 16 is viewable through the collectible-housing display structure 15 as depicted in FIG. 6A.

Figure 4A:
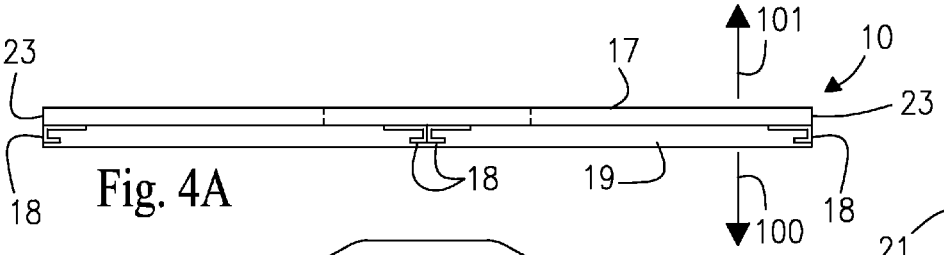
FIG. 4A is a top edge view of the board assembly of the preferred packaged collectible display assembly according to the present invention.
Figure 4:
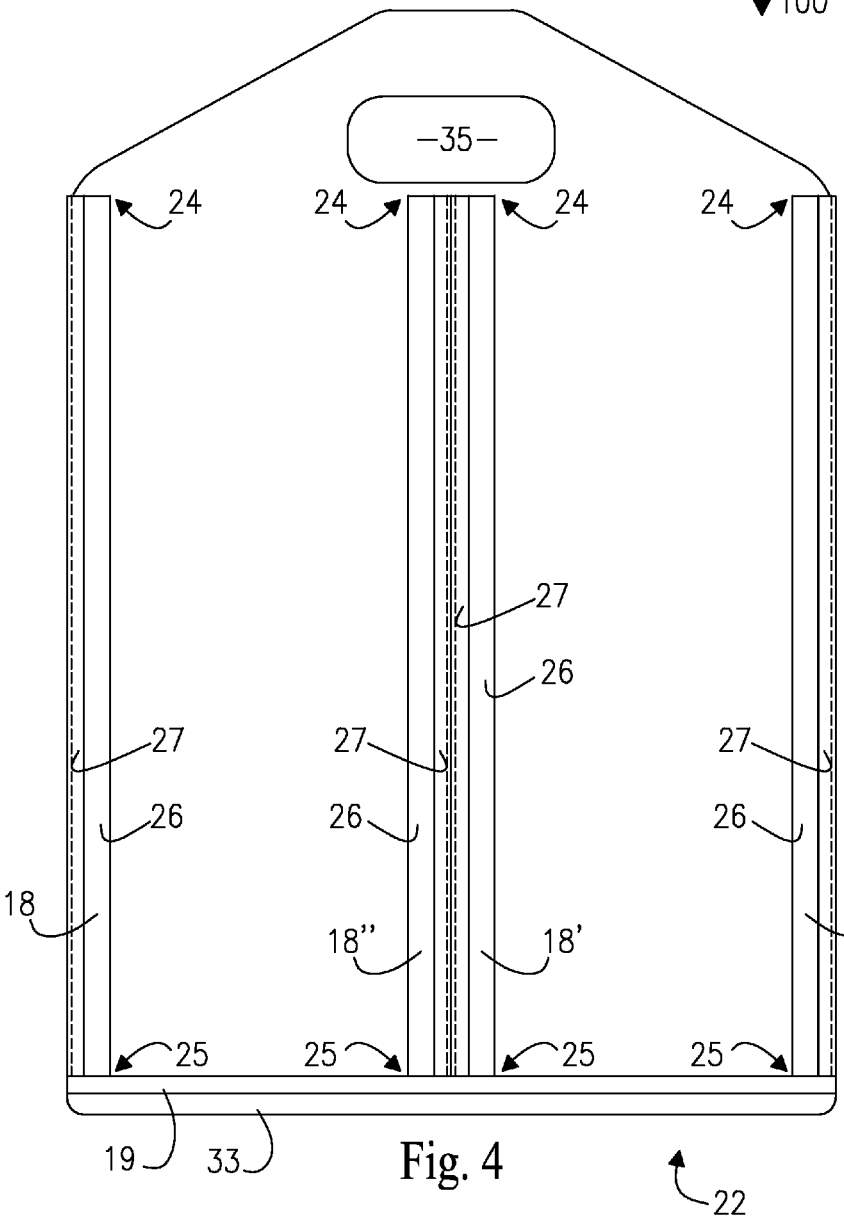
FIG. 4 is an anterior elevational view of the board assembly of the preferred packaged collectible display assembly according to the present invention.
Figure 4B:
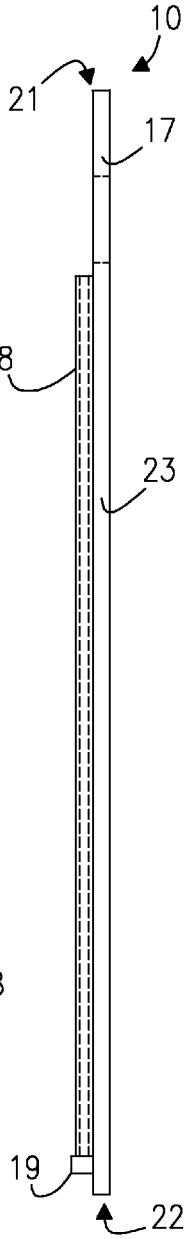
FIG. 4B is a lateral edge view of the board assembly of the preferred packaged collectible display assembly according to the present invention.
Figure 5:
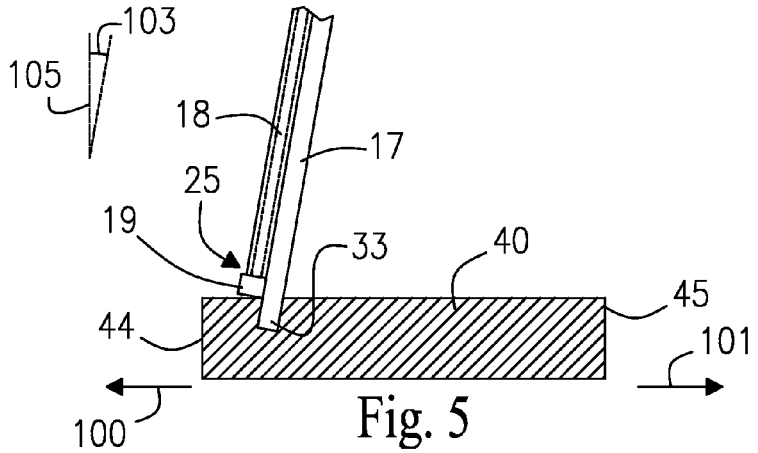
FIG. 5 is an enlarged fragmentary view of a bottom portion of a board assembly as mounted to a sectioned display base according to the present invention.

Each display assembly 10, 11, or 12 may preferably comprise a board assembly and a display base as at 40. The board assembly according to the present invention may be said to preferably comprise a backer board as depicted and referenced at 17; a first pair of opposed J-channel structures each of which channels are referenced at 18; and a ledge structure or element as referenced at 19. The backer board 17 essentially has a board length as generally depicted in FIGS. 4B, 8B, and 10B; a board width as generally depicted in FIGS. 4A, 8A, and 10A; a board thickness as depicted and referenced at 20 in FIG. 6A; an upper board end as at 21; a lower board end as at 22 and laterally opposed board edges as at 23. The upper board end 21 preferably comprises a handle cutout as at 35. The handle cutout 35 enables users to more easily carry the packaged collectible display assemblies 10, 11, or 12.

It will be understood from a comparative inspection of the drawing figures that the primary structural difference between the preferred embodiment 10 and the alternative embodiments 11 and 12 according to the present invention is that the preferred embodiment comprises a second pair of laterally opposed J-channel structures 18. The second pair of laterally opposed J-channel structures 18 is substantially identical to the first pair of laterally opposed J-channel structures 18. A second J-channel (as at 18") of the first pair of laterally opposed J-channel structures 18 and a first J-channel (as at 18') of the second pair of laterally opposed J-channel structures 18 are attached to the backer board 17 such that the linking portions 28 of the second and first J-channel structures (18" and 18') abut one another substantially equidistant intermediate the board width as generally and comparatively depicted in FIGS. 3 and 4.

Each J-channel structure 18 more specifically and preferably comprises a channel length as generally depicted in FIGS. 4B, 8B, and 10B; a J-shaped transverse cross-section as generally depicted in FIGS. 4A, 5B, 8A, and 10A; an upper channel end as at 24; and a lower channel end as at 25. The J-shaped transverse cross-section essentially comprises integrally formed portions, namely, a board-attachment portion as at 26; a backing-engagement portion as at 27; and a linking portion 28. The board-attachment portion 26 is preferably parallel to the backing-engagement portion 27, and the linking portion 28 is orthogonal to the board-attachment and backing-engagement portions 26 and 27 structurally linking said portions.

From a comparative inspection of the noted figures, the reader will see that the backing-engagement portion 27 is preferably abbreviated in length relative to the board-attachment portion 26. The board-attachment, backing-engagement, and linking portions 26-28 thus form or define a backing portion-receiving channel as at 29. Noting that the channel lengths are lesser in length than the board length as generally seen from an inspection of FIGS. 4B, 8B, and 10B, the J-channel structures 18 are preferably adhesively attached to the laterally opposed board edges 23 such that the backing portion-receiving channels 29 face one another as perhaps most clearly diagrammatically depicted in FIG. 5B.

Figure 2:
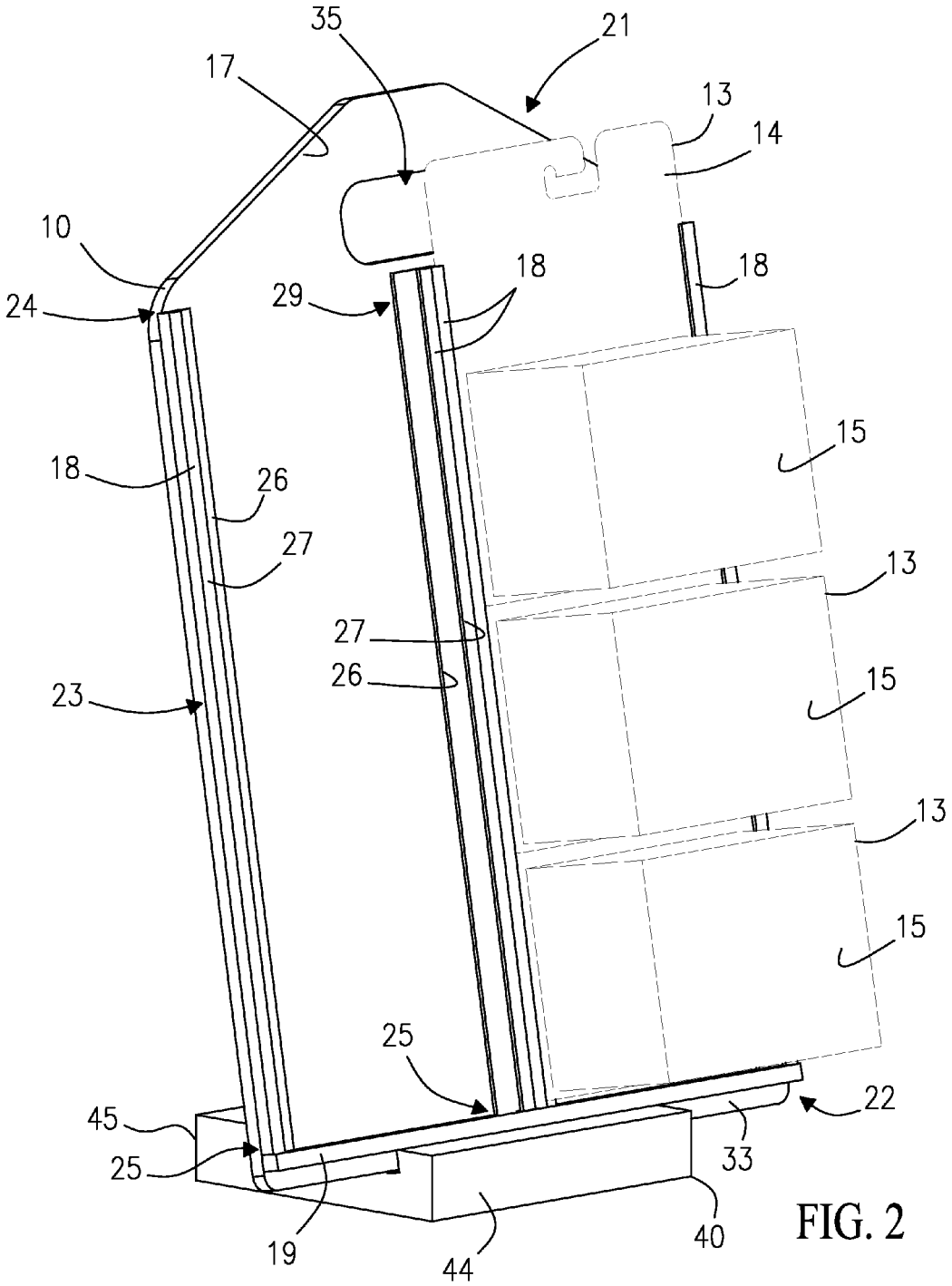
FIG. 2 is an anterior perspective view of the preferred packaged collectible display assembly according to the present invention showing three packaged collectible assemblies displayed by the preferred display assembly, and which three packaged collectible assembles are displayed in a single stacked column of three packaged collectibles.
Figure 3:
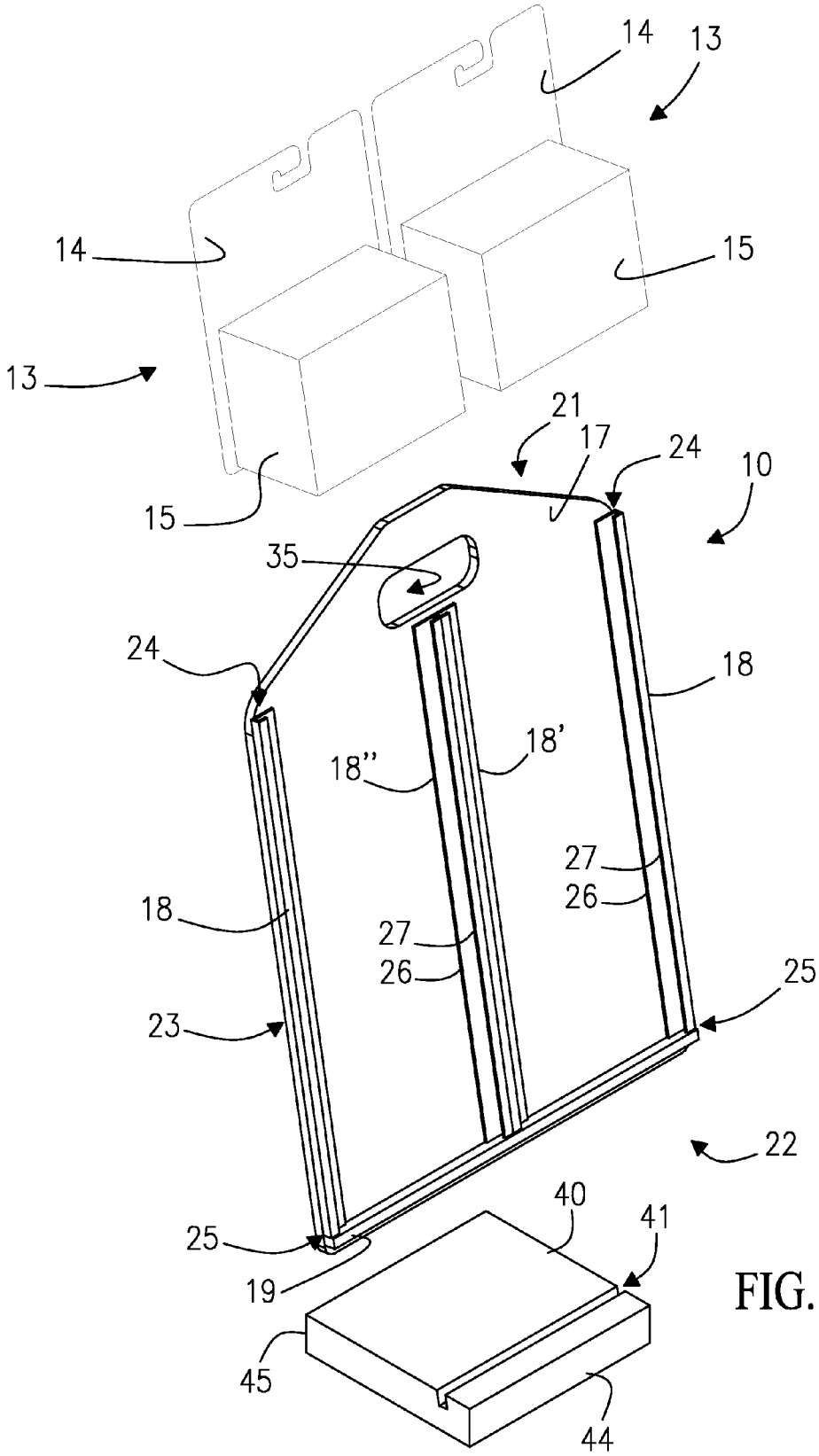
FIG. 3 is a partially exploded anterior perspective view of the preferred packaged collectible display assembly showing two side-by-side packaged collectible assemblies exploded from a board assembly and the board assembly exploded from a base assembly according to the present invention.
Figure 5A:
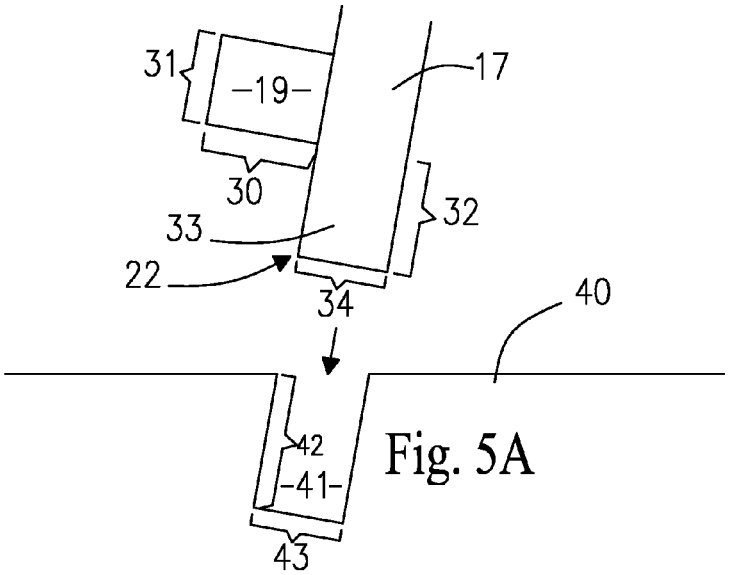
FIG. 5A is a further enlarged exploded fragmentary view of the bottom portion of a board assembly as exploded from a fragmentary diagrammatic display base according to the present invention.
Figure 5B:
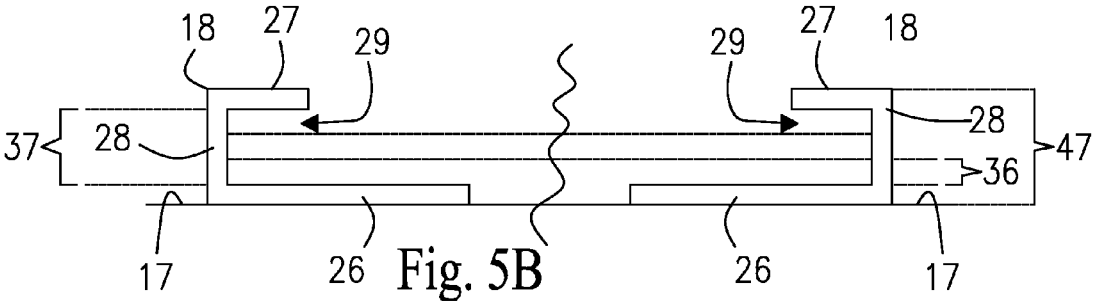
FIG. 5B is an enlarged diagrammatic transverse view of laterally opposed J-channel structures attached to a fragmentary backer board; the width of backer board has been diagrammatically abbreviated to highlight the thickness of depth of the matter-receiving channels.

Each backing portion 14 preferably comprises a backing portion thickness as at 36 in FIGS. 5B and 6A. The linking portions 28 preferably define an outer channel thickness as at 47 and a backing portion-receiving thickness as at 37 intermediate the board-attachment portions 26 and the backing-engaging portions 27. The outer channel thickness 47 is preferably lesser than the ledge depth 30. The backing portion-receiving thickness 37 is preferably at least two times or twice the thickness 36 of a select backing portion, but preferably three times or thrice the thickness 36 as perhaps most clearly depicted in FIG. 5B. The laterally opposed J-channel structures 18 may thus effectively receive overlapping backing portions 14 (as depicted in FIG. 6A) and the display assemblies 10-12 may receive columnar-stacked packaged collectibles 13 (as depicted in FIGS. 1 and 2).

The ledge structure 19 essentially or inherently comprises a ledge length, a ledge depth as at 30, and a ledge thickness as at 31. The ledge length is preferably substantially equal to the board width, and the ledge depth 30 and thickness 31 may be preferably substantially equal to one another. The ledge structure 19 is preferably adhesively attached to the backer board 17 adjacent the lower board end 22 such that the ledge length extends across the board width and abuts the lower channel ends 25. The lower board end 21 preferably extends past the ledge structure 19 a lower board distance 32 to form a lower board tongue as at 33.

The backing portion 14 of a packaged collectible assembly 13 is receivable by the opposed backing portion-receiving channels 29 at the upper channel ends 24 in the track formed by the opposed channels 29. The backing portion 14 is slidable along the channel lengths within the track formed by the channels 29 toward the ledge structure 19. The ledge structure 19 supports the backing portion 14, and the collectible-housing display structure 15 extends away from the backer board 17 and backing portions 14 in an anterior direction (as at 100) intermediate the backing-engagement portions 27. The backing-engagement portions 27 prevent the backing portion 14 from movement in the anterior direction 100.

The display base 40 preferably comprises a board-receiving groove as at 41, which groove 41 preferably comprises a (minimum) groove depth as at 42 and a (uniform) groove width as at 43. The board-receiving groove 41 receives the lower board tongue 33 of the lower board end 22. In this regard, the groove width 43 is preferably dimensioned to snugly accept the board thickness 34 and the (minimum) groove depth 42 is preferably dimensioned to accept the lower board distance 32 as generally depicted and referenced in FIG. 5A.

The board-receiving groove 41 preferably comprises an angle of inclination (from vertical 105) as generally depicted and referenced at 103. Excellent results have been obtained when the angle of inclination 103 is preferably 10 degrees from vertical 105. It is contemplated that the preferred angle of inclination 103 effectively enhances packaged collectible display and balances the display assemblies 10-12 when receivably displaying packaged collectible assemblies 13 therein as held or positioned by the display base 40.

The display base 40 further preferably comprises an anterior base portion or end as at 44 and a posterior base portion or end as at 45. The anterior direction is referenced at 100 and the posterior direction is referenced at 101. The board-receiving groove 41 is preferably formed in the display base 40 adjacent the anterior base portion 44, such that when the lower board tongue 33 of the lower board end 22 is received in the board-receiving groove 41, the upper board end 21 leans posteriorly via the angle of inclination 103 toward the posterior base portion 45 away from the anterior base portion 44, or in the posterior direction 101 opposite the anterior direction 100 for enhancing packaged collectible display.

Figure 11A:
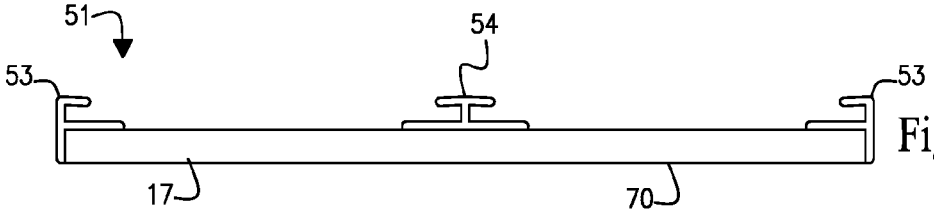
FIG. 11A is a top edge view of a first alternative board assembly of the packaged collectible display assembly according to the present invention with certain parts removed to highlight channel arrangements relative to the backer board.
Figure 11B:
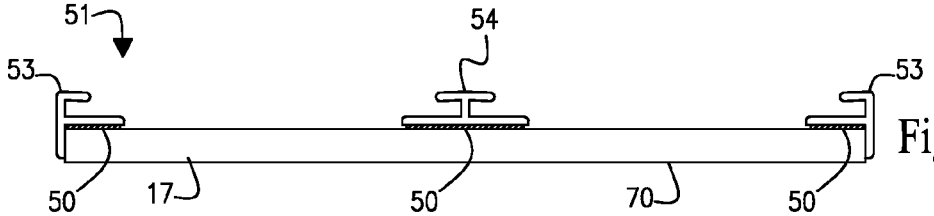
FIG. 11B is a top edge view of a second alternative board assembly of the packaged collectible display assembly according to the present invention with certain parts removed to highlight channel arrangements relative to the backer board.

Referencing FIGS. 11A and 11B, the reader will there compare top edge views of first and second alternative board assemblies 51 and 52 usable with or according to the packaged collectible display assembly of the present invention. The first and second alternative board assemblies 51 and 52 are depicted with the ledge structure or element 19 removed to highlight certain channel arrangements relative to the backer board 17.

The differences between the first alternative board assembly 51 and the second alternative board assembly are in the inclusion of foam type adhesive strip(s) 50 in the second alternative board assembly 52. Adhesive strips 50 comprise a more noticeable thickness as compared to fluid-based adhesives utilized preferably utilized to attach the F-channel constructions 53 and the H-channel construction 54 to the backer board 17 as is the case in the first alternative board assembly 51.

Figure 12:
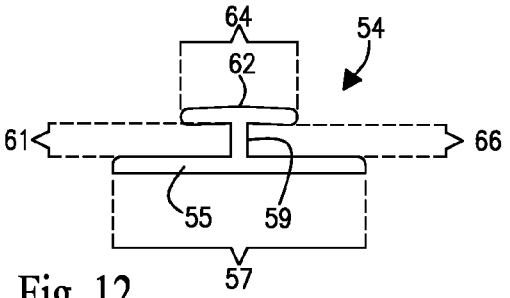
FIG. 12 is a first end view of an alternative H-channel construction according to the present invention.
Figure 13:
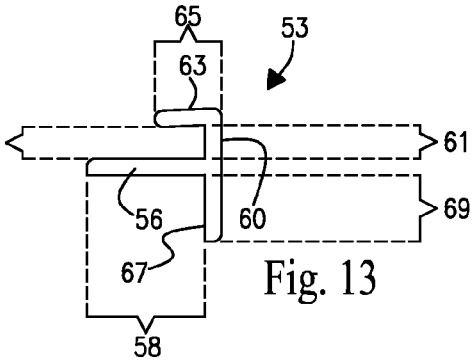
FIG. 13 is a first end view of an alternative F-channel construction according to the present invention.
Figure 14:
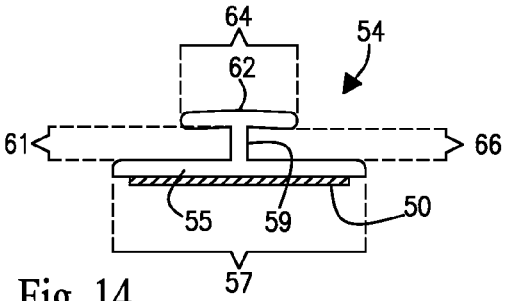
FIG. 14 is a second end view of the alternative H-channel construction according to the present invention shown with a foam adhesive strip attached to an interface section of the H-channel construction.
Figure 15:
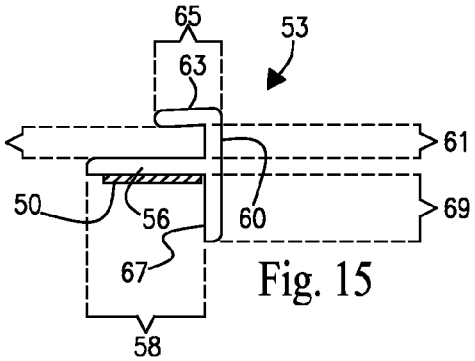
FIG. 15 is a second end view of the alternative F-channel construction according to the present invention shown with a foam adhesive strip attached to an interface section of the F-channel construction.

The reader is thus invited to further compare FIGS. 12-15. FIG. 12 is an end view of the alternative H-channel construction 54 according to the present invention, and FIG. 13 is an end view of the alternative F-channel construction 53 according to the present invention. FIG. 14 is an end view of the alternative H-channel construction according to the present invention shown with a foam adhesive strip 50 attached to an interface section or posterior board-engagement portion 55 of the H-channel construction 54, and FIG. 15 is an end view of the alternative F-channel construction 53 according to the present invention shown with a foam adhesive strip 50 attached to an interface section or posterior board-engagement portion 56 of the F-channel construction 53.

The dimensions of the H-channel construction 54 and the F-channel construction 53 are more particularly pointed out and referenced in FIGS. 12-15. The length or dimension 57 of the board-engagement portion 55 is preferably 0.750±0.035 inches. The length or dimension 58 of the board-engagement portion 56 is preferably 0.650±0.035 inches. The H-channel construction 54 and the F-channel construction 53 both comprise a linking portion as at 59 and 60, respectively. The length or dimension 61 of the linking portions 59 and 60 is preferably 0.125 inches.

The reader will carefully note that the H-channel construction 54 and the F-channel construction 53 both preferably comprise anterior backing-engagement sections or portions as at 62 and 63 respectively. The anterior backing-engagement section or portion 62 extends laterally in generally opposite directions from the linking portion 59 and the anterior backing-engagement section or portion 63 extends in a single direction from the linking portion 60. The length or dimension 64 of the anterior backing-engagement section or portion 62 is 0.513±0.030 inches, and the length or dimension 65 of the anterior backing-engagement section or portion 63 is 0.284±030 inches.

The extended portions or flange-like sections of portions 62 and 63 are preferably obliquely angled relative to the linking portions 59 and 60. The angle between the plane(s) (e.g. see plane 113) in which the portions 62 and 63 extend and the (vertical) plane 112 in which the linking portions 59 and 60 extend is preferably between 82.5 and 87.5 degrees, and preferably 85 degrees thereby leaving an angle 110 on the order of 5 degrees between the portions 62 and 63 and the (horizontal) plane 111. The length or dimension 66 between the termini of anterior backing-engagement section or portions 62 and 63 is preferably 0.110±0.015 inches. The reader will note that dimension 66 is less than dimension 61.

Figure 18A:
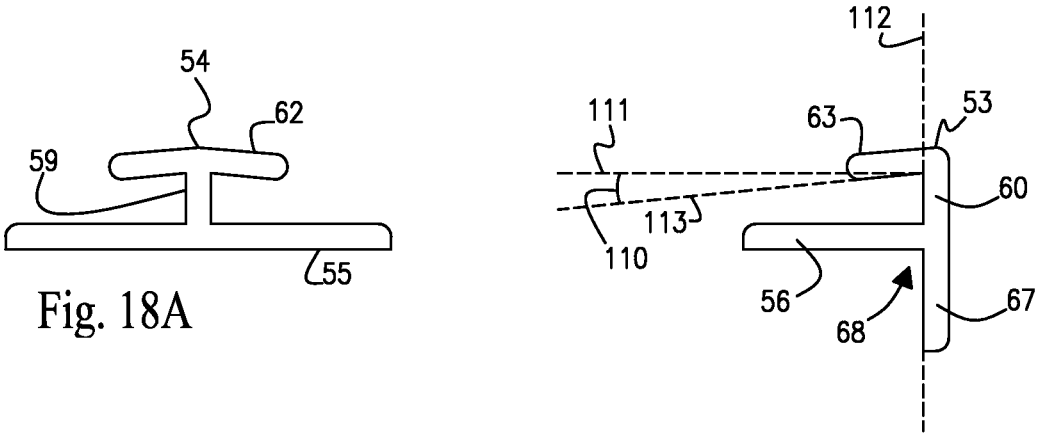
FIG. 18A is a first sequential diagrammatic end view depiction of the alternative H-channel construction according to the present invention juxtaposed adjacent the alternative F-channel construction according to the present invention, the H-channel and F-channel constructions being shown in a first relaxed state or configuration.
Figure 18B:
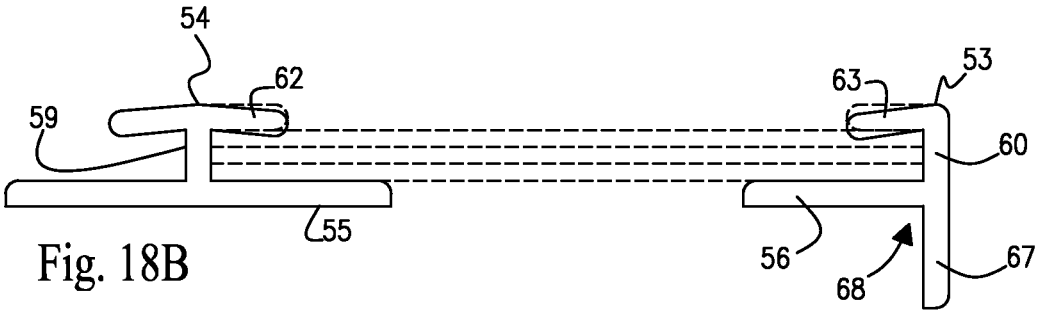
FIG. 18B is a second sequential diagrammatic end view depiction of the alternative H-channel construction according to the present invention juxtaposed adjacent the alternative F-channel construction according to the present invention, the H-channel and F-channel constructions being shown in the first relaxed state or configuration with phantom portions being depicted in broken lines to demonstrate a second actuated state or configuration for resiliently retaining phantom packaging portions also depicted in broken lines.
Figure 18C:
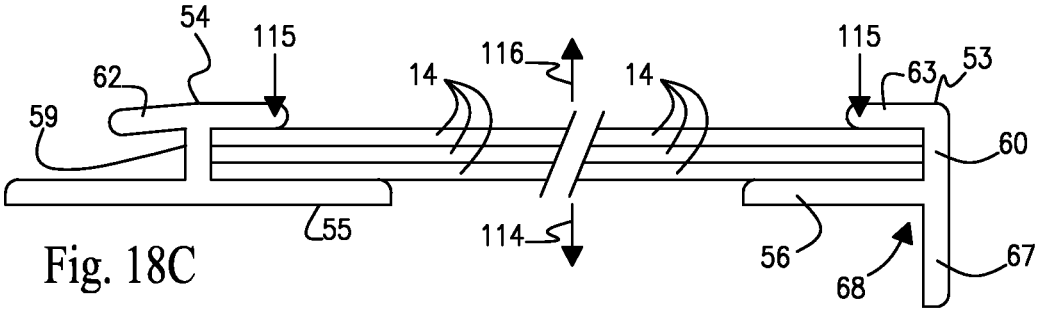
FIG. 18C is a third sequential diagrammatic end view depiction of the alternative H-channel construction according to the present invention juxtaposed adjacent the alternative F-channel construction according to the present invention, the H-channel and F-channel constructions being shown in the second actuated state or configuration for resiliently retaining packaging portions.

From a comparative inspection of FIGS. 18A through 18C, the reader will there consider that the H-channel construction 54 and the F-channel construction 53 are preferably formed from a resilient material such that the anterior backing-engagement section or portion 62 and the anterior backing-engagement section or portion 63 are preferably actuable intermediate a relaxed state as generally depicted in FIG. 18A and an actuated state as generally depicted in FIG. 18C. FIG. 18A generally depicts the anterior backing-engagement section or portions 62 and 63 in an oblique orientation relative to linking portions 59 and 60 whereas FIG. 18C depicts the anterior backing-engagement section or portions 62 and 63 in a generally (maximized) orthogonal orientation relative to the linking portions 59 and 60. Resilient return forces 115 are directed into the stacked backing portions 14 for resiliently directing the backing portion(s) 14 in a posterior direction 114 for preventing the backing portion(s) 14 from movement in the anterior direction 116.

The F-channel constructions each further preferably comprise a posteriorly extending flange or leg section as at 67. The posteriorly extending flanges 67 are preferably orthogonal to the board-attachment portions 56 for forming L-shaped channel-to-board attachment interfaces as at 68. The L-shaped channel-to-board attachment interfaces 68 basically function to increase the overall adhesive surface area contact between the F-channel constructions 53 and the backer board 17 for increasing the package-holding strength of the packaged collectible display system.

The posteriorly extending flanges 67 have a posteriorly extending length or dimension 69 preferably equal to 0.205±0.025 inches with a critical maximum length of 0.230 inches so as to provide a length or dimension 69 less than or equal to the board thickness (preferably 6 millimeters) as generally and comparatively depicted in FIGS. 16A-17C for enhancing the visual appeal of the packaged collectible display system or assembly. In other words, the terminal ends of the flanges 67 should stop either equal with the board thickness or above the plane 117 of the posterior surface 70 of the backer board 17, and never extend past the plane 117.

While the foregoing specifications set forth much specificity, the same should not be construed as setting forth limits to the invention but rather as setting forth certain preferred key components and features. For example, it is contemplated that the essence of the present invention provides a packaged collectible display system or assembly for displaying packaged collectibles. The packaged collectible display system according to the present invention preferably comprises, in combination, at least one packaged collectible assembly, a backer board, a pair of laterally opposed channel constructions, and a ledge element.

Each packaged collectible assembly comprises a backing portion and a collectible-housing display structure. The backer board comprises a board length, a board width, a board thickness, an upper board end, a lower board end, and laterally opposed board edges. Each channel construction comprises a channel length, a transverse cross-section, an upper channel end, and a lower channel end.

The transverse cross-sections comprise a board-attachment portion, a backing-engagement portion, and a linking portion. The backing-engagement portions are preferably abbreviated in length relative to the board-attachment portions and are resiliently actuable intermediate a relaxed state and an actuated state. The board-attachment portions are non-parallel relative to the backing-engagement portions when in the relaxed state. The linking portions are orthogonal to the board-attachment portions and oblique relative to the backing-engagement portions when in the relaxed state.

The board-attachment, backing-engagement, and linking portions thus form a backing portion-receiving channel. The channel lengths are lesser than the board length, and the channel constructions are adhesively attached to the laterally opposed board edges such that the backing portion-receiving channels face one another.

The ledge element or structure comprises a ledge length, a ledge depth, and a ledge thickness. The ledge length is substantially equal to the board width. The ledge structure is attached to the backer board adjacent the lower board end such that the ledge length extends across the board width and abuts the lower channel ends. The lower board end comprises a lower board tongue.

At least one backing portion is receivable by the opposed backing portion-receiving channels at the upper channel ends, and slidable along the channel lengths toward the ledge structure. The ledge structure thus supports a first backing portion. At least one collectible-housing display structure is extendable away from the backer board in an anterior direction intermediate the backing-engagement portions. The backing-engagement portions resiliently direct at least one backing portion in a posterior direction for preventing the at least one backing portion from movement in the anterior direction. The backing-engagement portions are preferably angled between 82.5 degrees and 87.5 degrees relative to the linking portions when in the relaxed configuration for accommodating a series of stacked backing portions when in the actuated state. The backing-engagement portions are preferably angled no greater than 90 degrees relative to the linking portions when in the actuated state for enhancing the visual appeal of the packaged collectible display system.

The packaged collectible display system or assembly according to the present invention may further preferably comprise a display base. The display base preferably comprises a board-receiving groove, which board-receiving groove comprises a groove depth and a groove width. The board-receiving groove receives the lower board tongue. The board-receiving groove preferably comprises an angle of inclination 10 degrees from vertical for enhancing packaged collectible display.

The display base preferably comprises an anterior base portion and a posterior base portion. The board-receiving groove is preferably formed in the display base adjacent the anterior base portion, and the lower board tongue is received in the board-receiving groove such that the upper board end leans in a posterior direction in superior adjacency to the posterior base portion.

The packaged collectible display system of assembly may preferably comprise a centralized H-channel construction and laterally-opposed, H-channel-flanking F-channel constructions as at 52. The F-channel constructions each comprise a posteriorly extending (as at arrow 114) flange 67. The posteriorly extending flanges 67 are preferably orthogonal to the board-attachment portions 56 for forming L-shaped channel-to-board attachment interfaces as at 68.

Figures 16A, 16B, 16C, 17A, 17B, 17C:
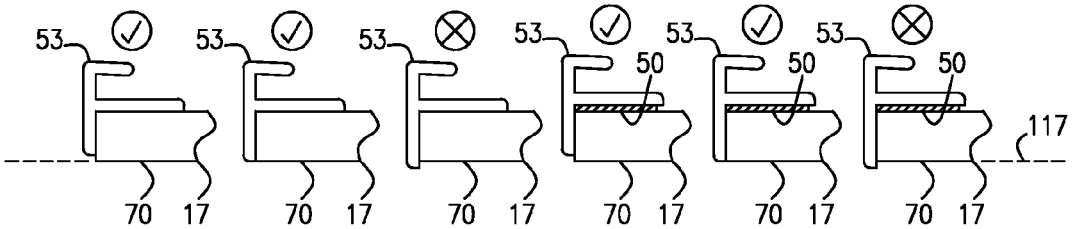
FIG. 16A is a third end view of the alternative F-channel construction according to the present invention adhesively attached to a fragmentary backer board section, and shown with an acceptable rearwardly or posteriorly extending leg or flange portion abbreviated or lesser in length relative to the thickness of the fragmentary backer board section.
FIG. 16B is a fourth end view of the alternative F-channel construction according to the present invention adhesively attached to a fragmentary backer board section, and shown with an acceptable rearwardly or posteriorly extending leg or flange portion equal in length relative to the thickness of the fragmentary backer board section.
FIG. 16C is a fifth end view of the alternative F-channel construction according to the present invention adhesively attached to a fragmentary backer board section, and shown with an unacceptable rearwardly or posteriorly extending leg or flange portion greater in length relative to the thickness of the fragmentary backer board section.
FIG. 17A is a sixth end view of the alternative F-channel construction according to the present invention attached to a fragmentary backer board section via a foam adhesive strip, and shown with an acceptable rearwardly or posteriorly extending leg or flange portion abbreviated or lesser in length relative to the thickness of the fragmentary backer board section.
FIG. 17B is a seventh end view of the alternative F-channel construction according to the present invention attached to a fragmentary backer board section via a foam adhesive strip, and shown with an acceptable rearwardly or posteriorly extending leg or flange portion equal in length relative to the thickness of the fragmentary backer board section.
FIG. 17C is an eighth end view of the alternative F-channel construction according to the present invention adhesively attached to a fragmentary backer board section via a foam adhesive strip, and shown with an unacceptable rearwardly or posteriorly extending leg or flange portion greater in length relative to the thickness of the fragmentary backer board section.

The L-shaped channel-to-board attachment interfaces 68 basically function to increase the adhesive surface area contact between the F-channel constructions 53 and the backer board 17 for increasing the package-holding strength of the packaged collectible display system or assembly. The posteriorly extending flanges 67 have a posteriorly extending length less than or equal to the board thickness for enhancing the visual appeal of the packaged collectible display system or assembly as generally and comparatively depicted in FIGS. 16A-17C. Notably, FIGS. 16C and 17C depict lengths that extend past plane 117, and these are marked as undesirable or unacceptable as indicated with circles with an X. Acceptable lengths are indicated with circles with a check mark.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures, the appended drawings, and the following claim limitations.

I claim:

1. A packaged collectible display system for displaying packaged collectibles, the packaged collectible display system comprising, in combination:

at least one packaged collectible assembly, each packaged collectible assembly comprising a backing portion and a collectible-housing display structure;

a backer board, the backer board comprising a board length, a board width, a board thickness, an upper board end, a lower board end, and laterally opposed board edges;

a first pair of laterally opposed channel construction comprising F-shaped F-channel constructions which comprise a channel length, a transverse cross-section, an upper channel end, and a lower channel end, the transverse cross-section comprising a board-attachment portion, a backing-engagement portion, and a linking portion, the backing-engagement portions being abbreviated in length relative to the board-attachment portions and being resiliently actuable intermediate a relaxed state and an actuated state, the board-attachment portions being non-parallel relative to the backing-engagement portions when in the relaxed state, the linking portions being orthogonal to the board-attachment portions and oblique relative to the backing-engagement portions when in the relaxed state, the board-attachment, backing-engagement, and linking portions thus forming a backing portion-receiving channel, wherein the F-channel constructions each comprise a posteriorly extending flange, the posteriorly extending flanges being orthogonal to the board-attachment portions for forming L-shaped channel-to-board attachment interfaces, the L-shaped channel-to-board attachment interfaces for increasing the adhesive surface area contact between the F-channel constructions and the backer board for increasing the package-holding strength of the packaged collectible display system, the channel lengths being lesser than the board length, the channel constructions being adhesively attached to the laterally opposed board edges such that the backing portion-receiving channels face one another;

a centralized H-shaped H-channel construction located intermediate the F-channel constructions, wherein the F-channel constructions are laterally opposed with respect to the H-channel construction and the F-channel constructions flank the H-channel construction; and a ledge structure, the ledge structure comprising a ledge length, a ledge depth, and a ledge thickness, the ledge length being substantially equal to the board width, the ledge structure being attached to the backer board adjacent the lower board end such that the ledge length extends across the board width and abuts the lower channel ends, the lower board end comprising a lower board tongue, at least one backing portion being receivable by the opposed backing portion-receiving channels at the upper channel ends, and slidable along the channel lengths toward the ledge structure, the ledge structure for supporting a first backing portion, at least one collectible-housing display structure being extendable away from the backer board in an anterior direction intermediate the backing-engagement portions, the backing-engagement portions for resiliently directing at least one backing portion in a posterior direction for preventing the at least one backing portion from movement in the anterior direction.

2. The packaged collectible display system of claim 1 wherein the backing-engagement portions are angled between 82.5 degrees and 87.5 degrees relative to the linking portions when in the relaxed configuration for accommodating a series of stacked backing portions when in the actuated state.

3. The packaged collectible display system of claim 2 wherein the backing-engagement portions are angled no greater than 90 degrees relative to the linking portions when in the actuated state for enhancing the visual appeal of the packaged collectible display system.

4. The packaged collectible display system of claim 1 comprising a display base, the display base comprising a board-receiving groove, the board-receiving groove comprising a groove depth and a groove width, the board-receiving groove for receiving the lower board tongue.

5. The packaged collectible display system of claim 4 wherein the board-receiving groove comprises an angle of inclination, the angle of inclination being 10 degrees from vertical, the angle of inclination for enhancing packaged collectible display.

6. The packaged collectible display system of claim 5 wherein the display base comprises an anterior base portion and a posterior base portion, the board-receiving groove being formed in the display base adjacent the anterior base portion, the lower board tongue being received in the board-receiving groove such that the upper board end leans in a posterior direction in superior adjacency to the posterior base portion.

7. The packaged collectible display system of claim 1 wherein the posteriorly extending flanges have a posteriorly extending length less than or equal to the board thickness, the posteriorly extending lengths for enhancing the visual appeal of the packaged collectible display system.

8. A packaged collectible display assembly for displaying a packaged collectible, the packaged collectible display assembly comprising:

a backer board, the backer board comprising a board length, a board width, a board thickness, an upper board end, a lower board end, and laterally opposed board edges;

a first pair of laterally opposed channel constructions, each channel construction comprising F-shaped F-channel constructions which comprise a channel length, a transverse cross-section, an upper channel end, and a lower channel end, the transverse cross-section comprising a board-attachment portion, a backing-engagement portion, a linking portion, the backing-engagement portion being abbreviated in length relative to the board-attachment portion and being resiliently actuable intermediate a relaxed state and an actuated state, the board-attachment portion being non-parallel relative to the backing-engagement portion when in the relaxed state, the linking portion being orthogonal to the board-attachment portion and oblique relative to the backing-engagement portion when in the relaxed state, the board-attachment, backing-engagement, and linking portions thus forming a backing portion-receiving channel, the channel lengths being lesser than the board length, the channel structures being adhesively attached to the laterally opposed board edges such that the backing portion-receiving channels face one another;

wherein the F-channel constructions each comprise a posteriorly extending flange, the posteriorly extending flanges being orthogonal to the board-attachment portions for forming L-shaped channel-to-board attachment interfaces, the L-shaped channel-to-board attachment interfaces for increasing the adhesive surface area contact between the F-channel constructions and the backer board for increasing the package-holding strength of the packaged collectible display assembly; a centralized H-shaped H-channel construction, wherein the F-channel constructions are laterally opposed with respect to the H-channel construction and the F-channel constructions flank the H-channel construction; and a ledge structure, the ledge structure comprising a ledge length, a ledge depth, and a ledge thickness, the ledge length being substantially equal to the board width, the ledge structure being attached to the backer board adjacent the lower board end such that the ledge length extends across the board width and abuts the lower channel ends, the lower board end comprising a lower board tongue, at least one backing portion being receivable by the opposed backing portion-receiving channels at the upper channel ends, and slidable along the channel lengths toward the ledge structure, the ledge structure for supporting a first backing portion, at least one collectible-housing display structure of at least one packaged collectible being extendable away from the backer board in an anterior direction intermediate the backing-engagement portions, the backing-engagement portions for resiliently directing the at least one backing portion in a posterior direction for preventing the at least one backing portion from movement in the anterior direction.

9. The packaged collectible display assembly of claim 8 wherein the backing-engagement portions are angled between 82.5 degrees and 87.5 degrees relative to the linking portions when in the relaxed configuration for accommodating a series of stacked backing portions when in the actuated state.

10. The packaged collectible display assembly of claim 9 wherein the backing-engagement portions are angled no greater than 90 degrees relative to the linking portions when in the actuated state for enhancing the visual appeal of the packaged collectible display system.

11. The packaged collectible display assembly of claim 8 comprising a display base, the display base comprising a board-receiving groove, the board-receiving groove comprising a groove depth and a groove width, the board-receiving groove for receiving the lower board tongue.

12. The packaged collectible display assembly of claim 11 wherein the board-receiving groove comprises an angle of inclination, the angle of inclination being 10 degrees from vertical, the angle of inclination for enhancing packaged collectible display.

13. The packaged collectible display assembly of claim 12 wherein the display base comprises an anterior base portion and a posterior base portion, the board-receiving groove being formed in the display base adjacent the anterior base portion, the lower board tongue being received in the board-receiving groove such that the upper board end leans in a posterior direction in superior adjacency to the posterior base portion.

14. The packaged collectible display system of claim 8 wherein the posteriorly extending flanges have a posteriorly extending length less than or equal to the board thickness, the posteriorly extending lengths for enhancing the visual appeal of the packaged collectible display system.

* * * * *